United States Patent [19]

Matsuura

[11] Patent Number: 4,740,095

[45] Date of Patent: Apr. 26, 1988

[54] PRINTER

[75] Inventor: Takanobu Matsuura, Takizawa, Japan

[73] Assignee: Alps Electric Co., Ltd., Japan

[21] Appl. No.: 848,989

[22] Filed: Apr. 7, 1986

[30] Foreign Application Priority Data

Apr. 5, 1985 [JP] Japan ..... 60-50063[U]

[51] Int. Cl.[4] ..... B41J 3/20

[52] U.S. Cl. ..... 400/185; 400/120; 101/93.15

[58] Field of Search ..... 400/120, 185, 186; 101/93.16, 93.17; 74/405, 439, 354; 464/47

[56] References Cited

U.S. PATENT DOCUMENTS

| | | | |
|---|---|---|---|
| 3,359,819 | 12/1967 | Veillette et al. | 74/439 |
| 3,405,565 | 10/1968 | Valliere | 74/354 |
| 3,661,339 | 5/1972 | Shimizu | 74/405 |
| 3,730,062 | 5/1973 | Morisawa | 74/405 |
| 3,798,993 | 3/1974 | Nayak | 74/405 |
| 3,855,448 | 12/1974 | Hanagata et al. | 400/120 |
| 4,414,893 | 11/1983 | Hori et al. | 101/93.17 |
| 4,657,417 | 4/1987 | Kikuchi et al. | 400/120 |

*Primary Examiner*—William Pieprz
*Attorney, Agent, or Firm*—Guy W. Shoup

[57] ABSTRACT

A printer has a mechanism for moving a print head from a print position to a non-print position, a drive source for driving the mechanism, and connection gears for transmitting a drive force resulting from the source to the mechanism. The printer is provided with a clutch mechanism for adjusting rotation of the connection gears. The clutch mechanism has a gear in engagement with the connection gears.

1 Claim, 5 Drawing Sheets

PRINTER

BACKGROUND OF THE INVENTION

1. Field of the Invention

The present invention relates to a printer in which an ink material held in a print ribbon is transferred to a recording medium by means of a print head for recording.

2. Description of the Prior Art

A conventional printer will be first described with reference to FIGS. 6 to 10.

Referring to FIG. 6, the printer comprises a carriage 1 on which a print head is mounted, which is slidably held on a guide rod not shown and provided opposite to a platen which will be described later, a wire 2, a drive pulley around which the wire 2 is wound, a driven pulley over which the wire 2 is stretched, and a stopper 5 secured to the wire 2, the stopper 5 being arranged within a recess 1*a* of the carriage 1. The printer further comprises a pulley gear 6*a* fitted in the pulley 3, a drive source or a motor 7, and gears 8*a*, 8*b* secured to both ends of an output shaft 9 of the motor 7, one pinion gear 8*a* being meshed with the pulley gear 6*a*, the other pinion gear being meshed with a connection gear 10*a*. A connection gear 10*b* is pressed against the connection gear 10*a* by means of a spring 16. The pulley gear 6*a* is meshed with a clutch gear 11, the clutch gear 11 being disengageably connected to an electromagnetic clutch 12. A paper feed shaft 13 is connected to the electromagnetic clutch 12, so that when the clutch gear 11 is rotated under the condition that the clutch gear 11 is connected to the electromagnetic clutch 12, the shaft 13 rotates to feed a recording paper described later to a print position on the surface of the platen.

A cam gear 14 is connected to the connection gears 10*a* and 10*b* in a positional relation of meshing with each other. This cam gear 14 comprises an intermittent gear portion 14*a*, a gear portion 14*b* and a stopper portion 14*c*, and is in a positional relation of meshing with the connection gears 10*a* and 10*b*. Since the connection gears 10*a*, 10*b* are pressed by means of the spring 16, a force acts on the connection gear 10*b* so that the gear 10*b* may be rotated in synchronism with the connection gear 10*a* due to a frictional load. Therefore, when a load imposed on the connection gear 10*b* is greater than the frictional load, only the connection gear 10*a* rotates, whereas when the load on the gear 10*b* is smaller than the frictional load, the connection gear 10*b* rotates in synchronism with the connection gear 10*a*.

In the aforementioned printer, at a carry time, the carriage 1 moves in a direction as indicated by the arrow A in FIG. 6. At that time, as the motor 7 turns on, the connection gear 10*a* is rotated in a direction as indicated by the arrow b in FIG. 7 through the pinion gear 8*b*, and at the same time, the connection gear 10*b* also tends to be rotated in the direction of the arrow b. At this time, however, an actuator 18 is locked at the stopper portion 14*c* of the cam gear 14 meshed with the connection gear 10*b*, and therefore the cam gear 14 is not rotated. This increases the load toward the connection gear 10*b*, and the connection gear 10*b* is not rotated neither. During printing, a solenoid 20 is turned ON to attract the actuator 18 against the bias of the spring 19. With this, the actuator 18 is disengaged from the stopper portion 14*c* of the cam gear 14 with the result that the load applied to the cam gear 14 decreases. The connection gear 10*b* is then rotated in synchronism with the connection gear 10*a* and the cam gear 14 rotates in a direction as indicated by the arrow C in FIG. 7 as the connection gear 10*b* rotates. Upon rotation through a certain angle, the connection gear 10*a* is meshed with the intermittent gear portion 14a, and a drive force of the motor 7 is transmitted to the cam gear 14 directly. There is a sectoral play (not shown) between the cam gear 14 and the cam 21 fitted into the cam gear 14. During that play, the cam gear 14 is free from a load and can be rotated under the frictional load alone between the connection gears 10*a* and 10*b*. During the play, the connection gear 10*a* is meshed with the intermittent gear portion 14*a* of the cam gear 14. The cam 21 is formed with a groove cam as will be described later. A pin 17*a* of a lever 17 enters the groove and as a result the lever 17 swings whereby a print head is pressed against (head down) the platen.

A mechanism for movement of the print head between a print position at which it is presses against the platen and a non-print position at which it is moved away from the platen will be described in detail with reference to FIGS. 8 to 10.

As shown in FIG. 8, an L-shaped winding rack 66 is arranged parallel with a shaft 60, and both ends of the shaft 60 extend through a connection portion 67 extended from both ends of the winding rack 66 so that the winding rack 66 may be rotated around the shaft 60. A number of rack teeth 66*a* are provided on the front surface of the winding rack 66, the rack teeth 66*a* being engagable with a winding gear 61 shownin FIGS. 9 and 10 and engageable with a hook 65 fixedly mounted on the carriage 1. The lever 17 is turnably supported on the shaft 60 so that the lever 17 may be superposed on one connection portion 67 of the winding rack 66. On the end of the lever 17 extending toward the winding rack 66 is provided a projection 69 in engagement with the upper end of the connection portion 67 as shown in FIG. 8, and a tension spring 70 is stretched from the upper end of said end to the lower end of the winding rack 66. On the end of the lever 17 extending to the side opposite the winding rack 66 is provided a pin 17*a*, and a cam portion 21*a* of a cam 21 is fitted into the extreme end of the pin 17*a*.

In FIGS. 9 and 10, reference numeral 74 denotes a ribbon cassette encasing therein a print ribbon or the like, 75 a recording paper, 76 a pressing projection provided on the carriage 1, and 77 a carriage stopper. FIG. 9 shows a state wherein a print head 101 is arranged at a print position at which the head is pressed against a platen rubber 102 of a platen 100, namely a head-down state. FIG. 10 shows a state wherein the print head 101 is arranged at a non-print position at which the head is parted from the platen rubber 102 of the platen 100, namely, a head-up state.

When the cam 21 rotates counterclockwise from the head-up state shown in FIG. 10, the pin 17*a* gradually moves in a direction of moving away from the rotation center of the cam 21 along the cam groove 21*a*. With this movement, the lever 17 rotates clockwise around the shaft 60, and the winding rack 66 is also biased by means of the tension spring 70 for clockwise rotation therewith whereby the rack teeth 66*a* are disengaged from the hook 65 into engagement with the teeth of the winding gear 61 and the upper surface of the winding rack 66 comes into contact with the pressing projection 76 provided on the undersurface of the carriage 1.

With further rotation of the cam 21, the lever 17 and the winding rack 66 further rotate clockwise. With this rotation, the carriage 1 is rotated toward the platen 100, and the print head 101 mounted on the carriage 1 comes into contact with the platen rubber 102 through the recording paper 75. It is to be noted that under the condition that the winding rack 66 is rotated and the rack teeth 66*a* and the winding gear 61 are not meshed with each other but remain abutted, the winding rack 66 is rotated to compress a coil spring 63 and at the same time raise the winding gear 61. When the carriage 1 moves so that the teeth of the winding gear 61 arrives at a position at which the teeth mesh with the rack teeth 66*a*, the gear 61 is forced down by means of the coil spring 63 so that the teeth thereof are meshed with each other to rotate the winding gear 61.

With further rotation of the cam 21, the lever 17 continuously rotates clockwise whereas the winding rack 66 cannot be rotated since the print head 101 is in contact with the rubber platen 102. Thus, because the winding track 66 cannot be rotated, the lever 17 is rotated while stretching-out the tension spring 70, which force serving as a force for pressing the print head 101 after all, resulting in a load for rotating the cam 21. As shown in FIG. 9, when the pin 17*a* assumes a position farthest from the rotational center of the cam groove 21*a*, a desired pressing force F is applied to the print head 101.

FIG. 11 shows the load characteristics for pressing the print head from the head-up to head-down of the printer according to this embodiment.

As shown in FIG. 11, load is zero from the head-up state (point X) to the state (point Y) in which the print head 101 comes into contact with the platen 100 for the first time, and load a is applied to stretch the tension spring 70 from the point Y to the point Z at which a desired pressing force F is obtained following the head-down.

When the carriage 1 is drawn with the print head 101 pressed as described above, the winding gear 61 is rotated on the rack teeth 66*a* of the winding rack 66 as shown in FIG. 9, and the print ribbon encased in the ribbon cassette 74 is wound, according to the movement of the carriage 1, by a bobbin 64 provided integral with the winding gear 61 through the shaft 62.

In the head-down state shown in FIG. 10, the pin 17*a* is positioned at the end of the cam groove 21*a* nearest to the rotational center, and the end of the lever 17 on the side of the winding rack 66 is lowered than that of the head-down state (see FIG. 9). When the end of the lever 17 is lowered as described above, the connection portion 67 of the winding rack 66 is pressed down by the projection 69 shown in FIG. 9, and the rack teeth 66*a* of the winding rack 66 is downwardly oriented. The rack teeth 66*a* is downwardly oriented whereby the hook 65 is pressed down by the extreme end and thereby the print head 101 is held on the carriage in the state where the head is apart from the platen 100. The rack teeth 66*a* is downwardly oriented and therefore apart from the winding gear 61. Thus, even if the carriage 1 is reciprocated, the bobbin 64 is not rotated and winding of the print ribbon is not effected.

The print head 101 may be disengaged (head-up) in accordance with the same principle as that of the head-down. The carriage 1 is moved in the direction of arrow B in FIG. 6 when not in printing. The cam gear 14 is rotated in the direction of the arrow d in FIG. 7, and the actuator 18 and the stopper portion of the cam gear 14 always remain unlocked.

By the moving mechanism as described above, the up and down of the print head 101 is carried out at predetermined non-printing and printing positions.

In the prior art construction as described above, when the print head 101 moves up or down, the extreme ends of the gears sometimes abut each other when the connection gear 10*a* and the intermittent gear 14*a* of the cam gear 14 begin to mesh with each other, which lead to gear locking or increase in load, resulting in a disorder of the motor, a deviation in print position, and the like.

SUMMARY OF THE INVENTION

It is an object of the present invention to provide a printer which can prevent a gear-lock avoiding abutment between the extreme ends of the gear teeth and prevent the disorder of the motor, while overcoming the above-described disadvantages.

In order to achieve the aforesaid object, a printer of the present invention comprises a connection gear for switching the transmission of a drive force from a drive source, a timing gear meshed with the connection gear, and a clutch mechanism for adjusting rotation of the connection gear.

The timing gear is brought into engagement with the connection gear to transmit the drive force through the timing gear, and the tooth-crests of the connection gear may be put in order with respect to the cam gear.

BRIEF DESCRIPTION OF THE DRAWINGS

FIG. 8 is a perspective view showing essential parts;

FIG. 9 is a side view showing the state of the head-down;

FIG. 10 is a side view showing the state of the head-up; and

DETAILED DESCRIPTION OF THE INVENTION AND PREFERRED EMBODIMENT

Figure 1:
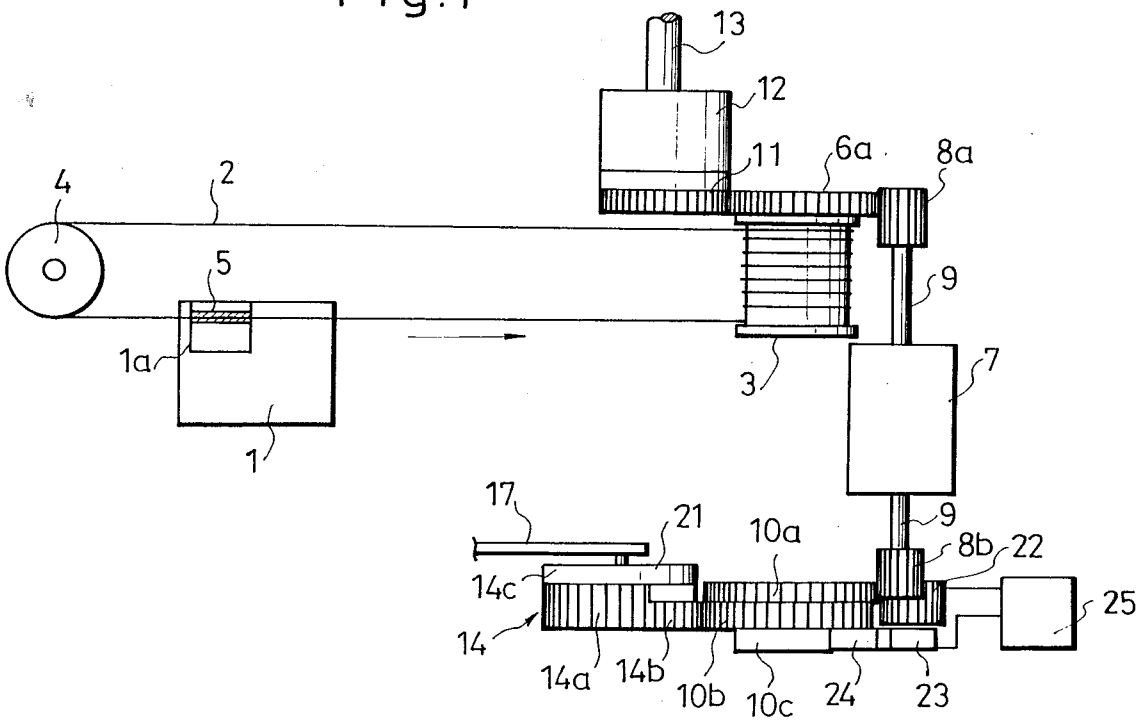
FIG. 1 is a plan view showing a schematic construction of one embodiment of a printer in accordance with the present invention.
Figure 2:
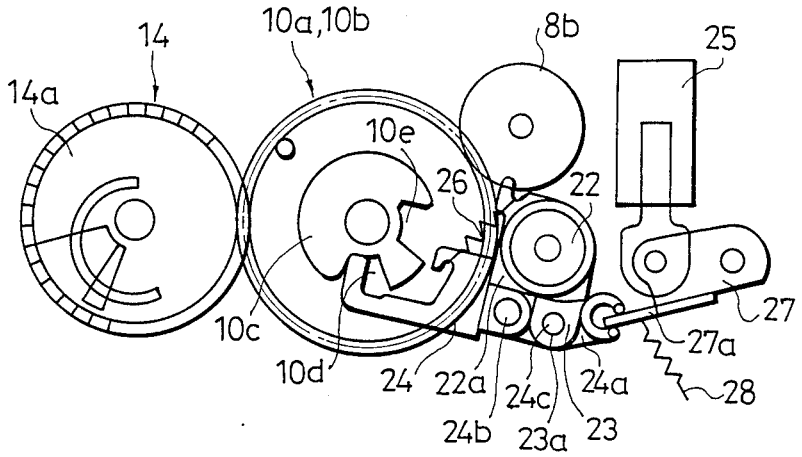
FIGS. 2 to 5 are respectively side views showing the operation of essential parts of the embodiment shown in FIG. 1.
Figure 3:
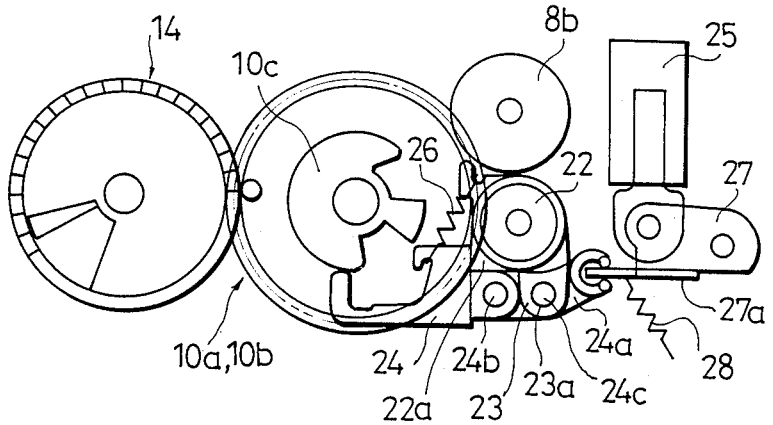

FIGS. 1 to 5 show one embodiment of the present invention. FIG. 1 illustrates the operation of the embodiment of the present invention. FIGS. 2 to 5 are respectively side views for explanation of the operation in the embodiment. Throughout these drawings, the same parts as those of prior art are indicated at the same reference numerals as of prior art, and the detailed description thereof will be omitted.

According to the present invention, in the drive force transmission station of the moving mechanism shown in the previously described prior art, there is provided a clutch mechanism having a separate timing gear 22 meshed with the connection gears 10*a*, 10*b*. A timing gear indicated at 22 is formed integral with a lever 23.

An engaging member 24, which is engageable with recesses 10*d*, 10*e* of a cam 10*c* formed integral with the connection gear 10*b*, has a lever 24*a* formed integral therewith. The lever 24*a* is provided with a hole 24*b* rotatably supported on a shaft not shown and a pin 24*c* rotatably fitted ito a hole 23*a* formed in the lever 23, the pin 24*c* being connected by being fitted into the hole 23*a*. A spring 26 is stretched between the timing gear 22 and the engaging member 24 to impart tension therebetween. The timing gear 22 is formed with a stopper portion 22*a*, which abuts against the lever 24 under the tension of spring 26 to hold the timing gear 22 in position when the lever 24 is moved to engage the timing gear 22 with the connection gears 10*a*, 10*b*. A solenoid 25 is provided to attract and disengage an actuator 27 to thereby switch a lever 27*a* formed integral with the actuator 27 and engaged with the extreme end of the lever 24*a* so that the timing gear 22 may be brought into engagement with and disengagement from the connection gears 10*a* and 10*b*. A spring 28 stretched over the lever 27*a* is locked at a frame not shown.

In the following, engagement and disengagement of the timing gear 22 with respect to the connection gears 10*a* and 10*b* will be described with reference to FIGS. 2 to 5.

Figure 5:
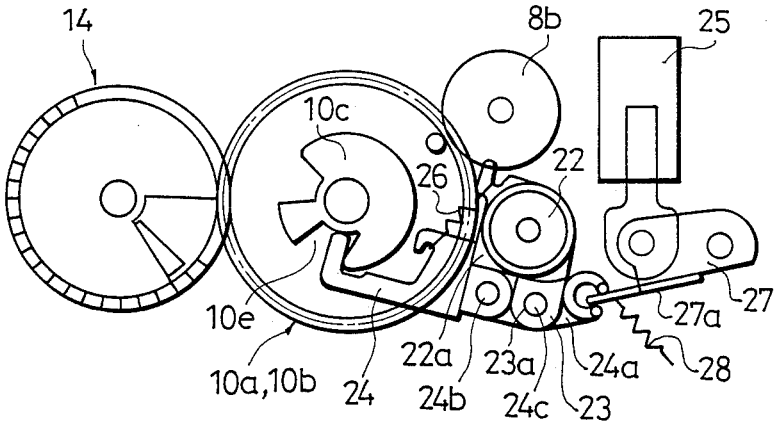
Figure 6:
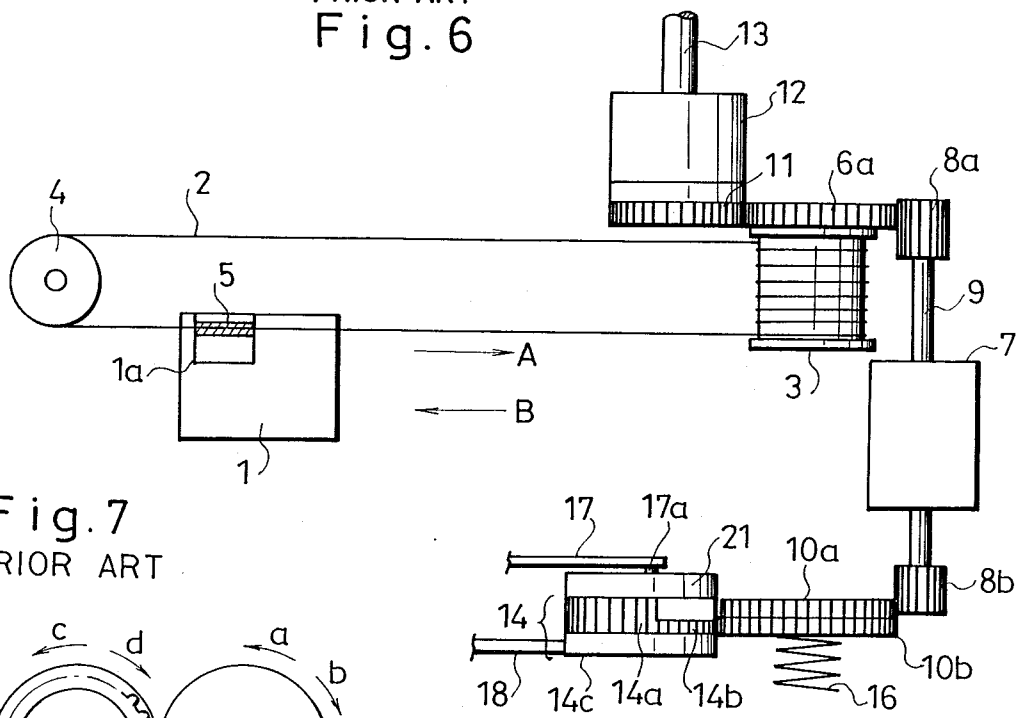
PRIOR ART Fig. 6
FIG. 6 is a plan view showing a schematic construction of a conventional printer.
Figure 7:
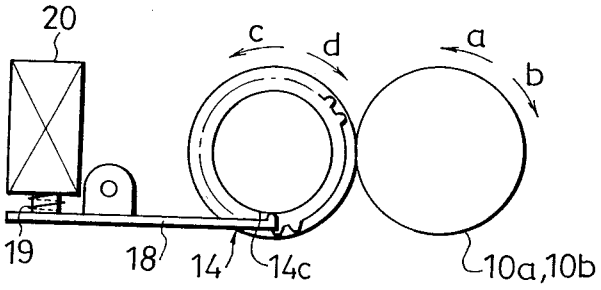
Fig. 7 PRIOR ART
FIG. 7 is a side view illustrating a connection gear portion provided in the printer shown in FIG. 6.
Figure 8:
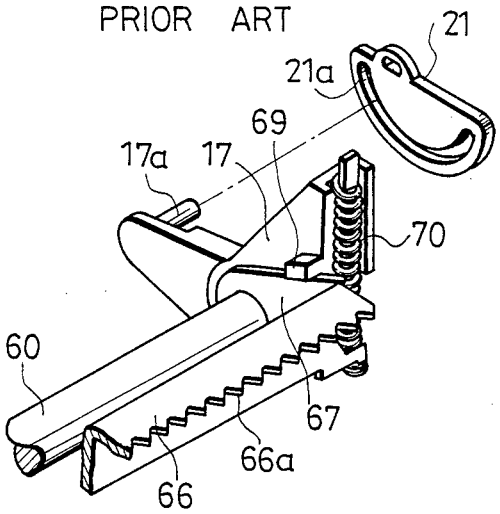
Fig. 8 PRIOR ART
FIGS. 8 to 10 illustrate a mechanism for movement of a print head provided in the printer shown in FIG. 6.
Figure 9:
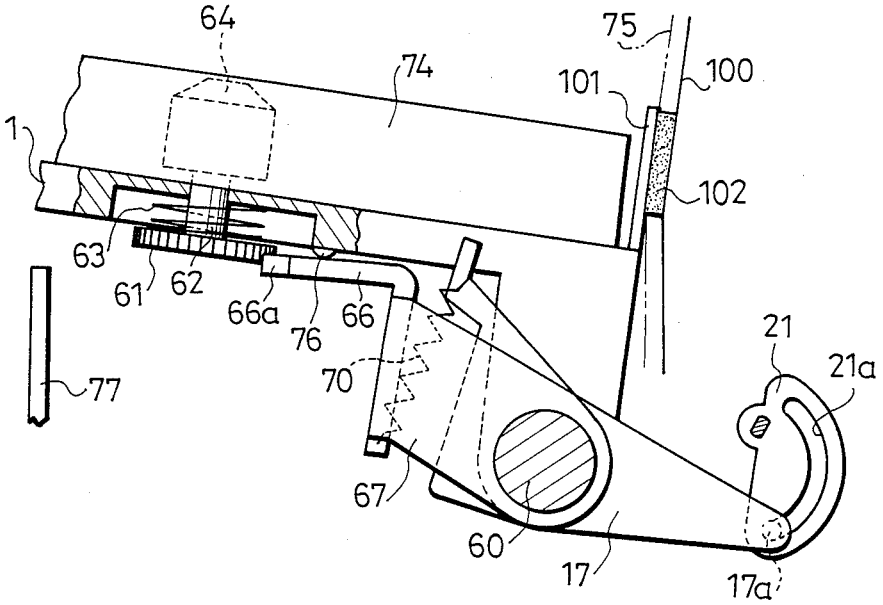
Fig. 9 PRIOR ART
Figure 10:
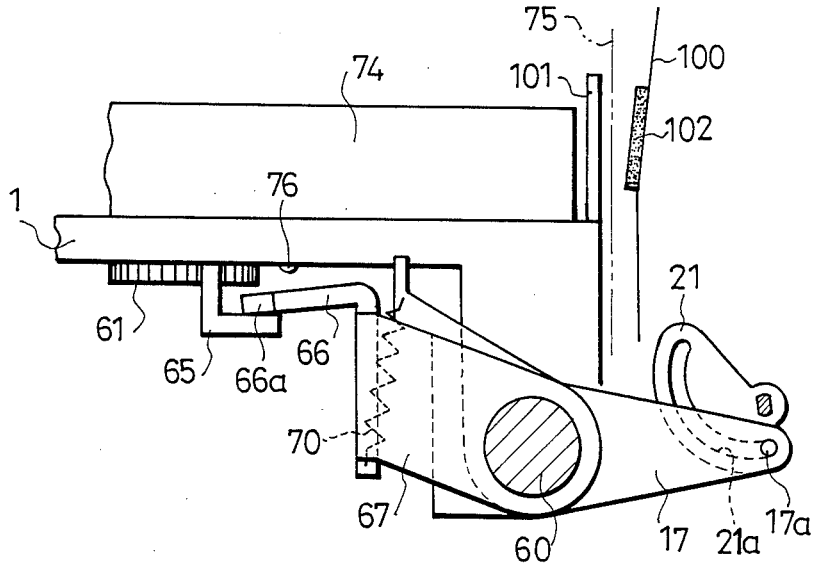
Fig.10 PRIOR ART
Figure 11:
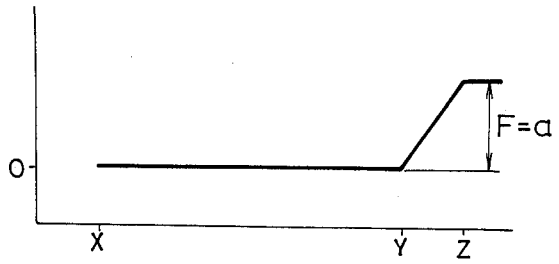
Fig.11 PRIOR ART
FIG. 11 is a characteristic curve showing the load characteristics obtained in the printer shown in FIG. 6.

At the head-up, as shown in FIG. 5, the extreme end of the engaging member 24 is in engagement with the recess 10*e* of the cam 10*c* formed integral with the connection gear 10*b*, and the solenoid 25 is in OFF state, and the lever 27*a* is pulled by means of the spring 28 and therefore the timing gear 22 is disengaged from the connection gears 10*a* and 10*b*. At that time, the intermittent gear portion 14*a* of the cam gear 14 is not meshed with the connection gear 10*a*, as shown in FIG. 5.

Figure 4:
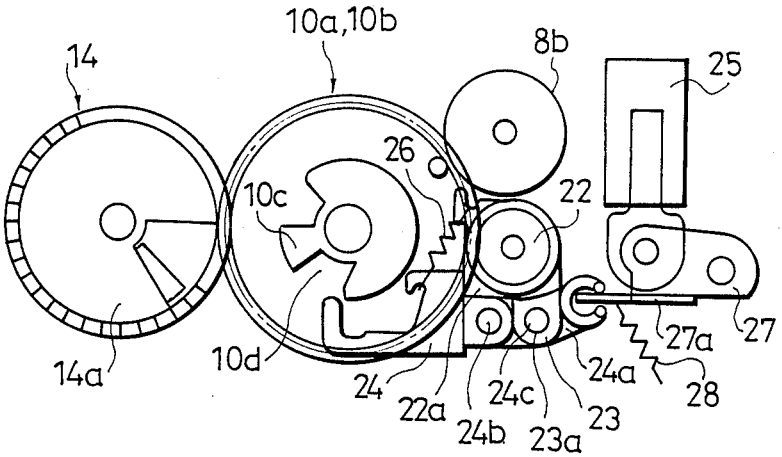

At the head-down, as shown in FIG. 4, the solenoid 25 is turned ON, and the actuator 27 is attracted by the solenoid 25. With this, the lever 23 and lever 24*a* swing so that the timing gear 22 comes into contact with the connection gears 10*a* and 10*b*. At that time, the lever 24*a* is disengaged from the recess 10*d* of the cam 10*c*. The extreme ends of the connection gears 10*a*, 10*b* and teeth of the timing gear 22 are in contact with each other, the lever 23 temporarily escapes against the force of the spring 26. When the connection gear 10 slightly rotates, the timing gear 22 is meshed with the connection gears 10*a*, 10*b* under the influence of tension of the spring 26. Because of this, the connection gears 10*a*, 10*b* synchronously rotate through the timing gear 22. As previously mentioned, during the sectoral play between the cam 21 and the cam gear 14, the connection gear 10*a* is meshed with the intermittent gear portion 14*a* of the cam gear 14. Since at this time, the lever 24*a* is positioned above the cam 10*c* of the connection gear 10*b*, the timing gear 22 remains meshed with the connection gears 10*a*, 10*b* even if the solenoid 25 is turned OFF. When the head-up operation has been completed and the connection gear 10*b* continuously rotates so that the lever 24*a* reaches the other recess 10*a* of the cam 10*c*, the lever 23 and lever 24*a* are swung by the spring 28 to disengage the timing gear 22 from the connection gears 10*a*, 10*b*, whereby the connection gear 10*a* rotates without load and the print head remains in its down state (see FIGS. 2 and 3). To achieve the head-up operation, the solenoid 25 may be again turned ON to assume the state shown in FIG. 5 by the aforementioned cycle of operation.

As described above, the present invention is designed to provide a clutch mechanism for adjusting rotation of connection gears, and therefore has the excellent effects as follows:

(1) The connection gear 10*b* is set in one given position where it is normally meshed with the cam gear, and it is driven to rotate upon engagement of the timing gear to the two connection gears 10*a*, 10*b* together, thereby eliminating the occurrence of gearlock heretofore encountered by the arrangement where connection gear 10*b* is pushed against the connection gear 10*a* in order to drive them together frictionally.

(2) Since there is exist no frictional load of the connection gears as in prior art, during the operations other than the head up and down operation, an extra load is not applied to decrease a load on the drive source.

What is claimed is:

1. A printer having a moving mechanism for intermittently moving a print head mounted on a carriage movable along a platen between a print position wherein the head is pressed against the platen and a non-print position wherein the head is moved away from the platen, wherein an improved head moving mechanism comprises:

a drive source providing a rotational output;

a first connection gear driven in rotation by the output of said drive source;

a second connection gear disposed coaially in parallel with the first connection gear and being rotatable independently of the first connection gear;

a cam gear in mesh with the second connection gear and connected coaxially with an intermittent gear which is rotatable in parallel with the cam gear, said intermittent gear being engageable at a predetermined rotational position with said first connection gear to provide a driving output to said moving mechanism upon rotation of said cam gear to the predetermined position by said second connection gear;

a timing gear movable to from a non-engaged position to an engaged position wherein it engages in mesh with both said first and second connection gears together, wherein said second connection gear is driven by said timing gear to rotate by the output of the drive source rotating said first connection gear meshing with said timing gear, said cam gear is rotated by the second connection gear, said intermittent gear is rotated with the cam gear to the predetermined rotational position to engage the first connection gear, and said driving output of the intermittent gear engaged with the first connection gear is thereby provided to the moving mechanism; and moving means for controllable moving said timing gear from the non-engaged position to the engaged position to the engage position when it is desired to drive said moving mechanism.

* * * * *